US010867739B2

(12) United States Patent
Uchida et al.

(10) Patent No.: US 10,867,739 B2
(45) Date of Patent: Dec. 15, 2020

(54) CERAMIC CORE, WIRE-WOUND ELECTRONIC COMPONENT, AND METHOD FOR PRODUCING CERAMIC CORE

(71) Applicant: MURATA MANUFACTURING CO., LTD., Kyoto-fu (JP)

(72) Inventors: Takeshi Uchida, Nagaokakyo (JP); Kazuyoshi Ishizuka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 479 days.

(21) Appl. No.: 15/583,498

(22) Filed: May 1, 2017

(65) Prior Publication Data

US 2017/0330672 A1 Nov. 16, 2017

(30) Foreign Application Priority Data

May 13, 2016 (JP) ..... 2016-096760

(51) Int. Cl.

| | |
|---|---|
| ***H01F 17/04*** | (2006.01) |
| ***H01F 27/24*** | (2006.01) |
| ***H01F 27/255*** | (2006.01) |
| ***H01F 27/29*** | (2006.01) |
| ***H01F 27/28*** | (2006.01) |

(Continued)

(52) U.S. Cl.

CPC ..... *H01F 27/24* (2013.01); *H01F 17/045* (2013.01); *H01F 27/255* (2013.01); *H01F 27/2823* (2013.01); *H01F 27/29* (2013.01); *H01F 27/292* (2013.01); *H01F 41/0246* (2013.01); *H01F 41/06* (2013.01)

(58) Field of Classification Search

CPC ... H01F 41/0206; H01F 17/045; H01F 27/292

USPC ..... 336/221

See application file for complete search history.

(56) References Cited

U.S. PATENT DOCUMENTS 4,926,151 A * 5/1990 Morinaga ..... H01F 17/045 335/296

5,680,087 A * 10/1997 Sakata ..... H01F 27/292 336/192

(Continued)

FOREIGN PATENT DOCUMENTS

CN 1890763 A 1/2007

JP H1-173914 U 12/1989

(Continued)

OTHER PUBLICATIONS

An Office Action mailed by the Chinese Patent Office dated Aug. 3, 2018, which corresponds to Chinese Patent Application No. 201710329083.2 and is related to U.S. Appl. No. 15/583,498 with English language translation.

(Continued)

*Primary Examiner* — Alexander Talpalatski

*Assistant Examiner* — Joselito Baisa

(74) *Attorney, Agent, or Firm* — Studebaker & Brackett PC

(57) ABSTRACT

A ceramic core, which is made of a ferrite material including Ni and Zn, includes an axial core extending in a length direction and a pair of flange portions disposed at both ends of the axial core in the length direction. The dimension L of the ceramic core in the length direction satisfies 0 mm<L≤1.1 mm. The surface roughness of a ridge portion of the axial core is less than or equal to 2.5 μm.

5 Claims, 9 Drawing Sheets

(51) Int. Cl.
*H01F 41/02* (2006.01)
*H01F 41/06* (2016.01)

(56) References Cited

U.S. PATENT DOCUMENTS 6,727,792 B2 * 4/2004 Amada ..... H01F 17/045 336/192
7,183,886 B2 * 2/2007 Ooki ..... H01F 17/045 336/83
7,300,615 B1 * 11/2007 Sanchez ..... H01F 1/14758 264/263
7,477,122 B2 * 1/2009 Iguchi ..... H01F 17/045 336/192
2002/0190830 A1 * 12/2002 Matsumoto ..... H01F 3/10 336/83
2004/0233033 A1 * 11/2004 Choi ..... H01C 7/027 338/22 R
2005/0145408 A1 * 7/2005 Hess ..... H01F 27/292 174/541
2010/0304083 A1 * 12/2010 Naritomi ..... B29C 45/14221 428/141
2011/0261019 A1 * 10/2011 Makita ..... H01L 27/1229 345/175
2011/0267167 A1 * 11/2011 Ogawa ..... H01F 41/098 336/221
2012/0094063 A1 * 4/2012 Hasegawa ..... C23C 4/02 428/132
2013/0154784 A1 * 6/2013 Hachiya ..... H01F 5/003 336/200
2013/0194060 A1 * 8/2013 Nakada ..... H01F 27/00 336/192
2014/0007752 A1 * 1/2014 Sato ..... B28D 1/225 83/651

FOREIGN PATENT DOCUMENTS

JP 3016658 U 7/1995
JP H7-183126 A 7/1995
JP H9-266123 A 10/1997
JP 2003-257725 A 9/2003
JP 2003-282343 A 10/2003
JP 2004-235372 A 8/2004
JP 2005-305624 A 11/2005
JP 2005-317591 A 11/2005
JP 2010265118 A * 11/2010
JP 5915920 B1 5/2016

OTHER PUBLICATIONS

An Office Action; "Notification of Reasons for Refusal," Mailed by the Japanese Patent Office dated Nov. 6, 2018, which corresponds to Japanese Patent Application No. 2016-096760 and is related to U.S. Appl. No. 15/583,498; with English language translation.

* cited by examiner

CERAMIC CORE, WIRE-WOUND ELECTRONIC COMPONENT, AND METHOD FOR PRODUCING CERAMIC CORE

CROSS REFERENCE TO RELATED APPLICATIONS

This application claims benefit of priority to Japanese Patent Application 2016-096760 filed May 13, 2016, the entire content of which is incorporated herein by reference.

TECHNICAL FIELD

The present disclosure relates to a ceramic core composed of a ferrite material including Ni and Zn, a wire-wound electronic component including the ceramic core, and a method for producing a ceramic core composed of a ferrite material including Ni and Zn.

BACKGROUND

Some existing wire-wound electronic components (such as coil components) include a ceramic core composed of a ferrite material including Ni and Zn (see, for example, Japanese Unexamined Patent Application Publication No. 2005-305624).

As electronic devices, such as cellular phones, have been reduced in size, reduction in size of wire-wound electronic components, used in the electronic devices, is increasingly required. However, as the wire-wound electronic components become smaller, faulty winding, such as irregular winding or breakage of the wire, becomes more likely to occur, and the production yield of the wire-wound electronic components decreases.

SUMMARY

Accordingly, it is an object of the present disclosure to provide a ceramic core, a wire-wound electronic component, and a method for producing a ceramic core, with which decrease in the production yield can be suppressed.

According to preferred embodiments of the present disclosure, a ceramic core includes an axial core extending in a length direction and a pair of flange portions disposed at both ends of the axial core in the length direction. The ceramic core is composed of a ferrite material including Ni and Zn. A dimension L of the ceramic core in the length direction satisfies 0 mm<L≤1.1 mm. A surface roughness Rz of a ridge portion of the axial core is less than or equal to 2.5 μm.

With this structure, in the small ceramic core having a length L of 0 mm<L≤1.1 mm, the surface of the ridge portion of the axial core is a smooth surface having only small protrusions and recesses. Therefore, when a wire is wound around the axial core, occurrence of faulty winding, such as irregular winding, can be suppressed. Thus, decrease in the production yield can be suppressed.

In the ceramic core, preferably, each of the flange portions projects from the axial core in a height direction and a width direction that are perpendicular to the length direction; a ratio t/T of a dimension t of the axial core in the height direction to a dimension T of each of the flange portions in the height direction satisfies 0<t/T≤0.6; and a ratio w/W of a dimension w of the axial core in the width direction to a dimension W of each of the flange portions in the width direction satisfies 0<w/W≤0.6.

With this structure, the ceramic core, having a small size, can have a large step between the axial core and the flange portion in the height direction and a large step between the axial core and the flange portion in the width direction. Thus, the ceramic core, having a small size, can have a large winding region (region in which the wire can be wound), while suppressing decrease in the production yield.

In the ceramic core, preferably, a dimension of each of the flange portions in the length direction is in a range of 0.08 to 0.15 mm.

In the ceramic core, preferably, a center of the axial core in a height direction that is perpendicular to the length direction is offset from a center of each of the flange portions in the height direction.

With this structure, when, for example, the ceramic core is used for a wire-wound electronic component, the electrodes can be formed on end surfaces of the flange portions located in a direction opposite to the direction in which the axial core is offset, and therefore the axial core and the electrodes can be separated from each other by a larger distance. Thus, the electrodes can be formed in a larger region, and occurrence of a faulty joint between the electrodes and the wire can be suppressed. As a result, decrease in the production yield can be suppressed.

According to preferred embodiments of the present disclosure, a wire-wound electronic component includes the ceramic core, an electrode formed on one of end surfaces of each of the flange portions in a height direction that is perpendicular to the length direction, and a wire that is wound around the axial core and that includes end portions that are electrically connected to the electrodes.

With this structure, in the small ceramic core having a length L that satisfies 0 mm<L≤1.1 mm, the surface of the ridge portion of the axial core is a smooth surface having only small protrusions and recesses. Therefore, when a wire is wound around the axial core, occurrence of faulty winding, such as irregular winding, can be suppressed. Thus, decrease in the production yield can be suppressed.

According to preferred embodiments of the present disclosure, a method for producing a ceramic core includes a molding step of molding a ferrite material including Ni and Zn to form a molded body; a heat treatment step of heat-treating the molded body to obtain a calcined body; a barrel polishing step of barrel-polishing the calcined body; and a firing step of firing the calcined body after being barrel-polished to obtain a sintered body. In the heat treatment step, the molded body is heat-treated so that a ratio D1/D2 of an average grain diameter D1 of the calcined body to an average grain diameter D2 of the sintered body is in a range of 0.1 to 0.5.

With the production method, the average grain diameter D1 of the calcined body is 0.1 to 0.5 times the average grain diameter D2 of the sintered body (that is, the ceramic core). Therefore, when barrel polishing is performed, the grain diameter of crystal grains is smaller than that of the crystal grains after being fired. Thus, the calcined body after being barrel-polished can have a small surface roughness. Moreover, because firing is performed after barrel polishing, the sintered body after being fired can have a smoother surface. Thus, when winding a wire around the surface of the ceramic core, occurrence of faulty winding, such as irregular winding, can be suppressed. As a result, decrease in the production yield can be suppressed.

In the method for producing a ceramic core, preferably, in the heat treatment step, the molded body is heat-treated so that the ratio D1/D2 is in a range of 0.15 to 0.5.

With the production method, sufficient strength can be provided to the calcined body by heat treatment. Thus, the calcined body when being barrel-polished can have high strength, so that occurrence of a fault, such as breakage or chipping of the calcined body, during barrel polishing can be suppressed. As a result, decrease in the production yield can be suppressed.

In the method for producing a ceramic core, preferably, the sintered body includes an axial core extending in a length direction and a pair of flange portions disposed at both ends of the axial core in the length direction; a dimension L of the sintered body in the length direction satisfies 0 mm<L≤1.1 mm; and a dimension of each of the flange portions in the length direction is in a range of 0.08 to 0.15 mm.

In the method for producing a ceramic core, preferably, the heat treatment step, the barrel polishing step, and the firing step are performed so that a surface roughness Rz of a ridge portion of the axial core of the sintered body is less than or equal to 2.5 μm.

With the production method, the surface roughness Rz of the ridge portion of the axial core of the sintered body can be made small, and the surface of the ridge portion can be formed as a smooth surface having only small protrusions and recesses. Thus, when a wire is wound around the axial core, occurrence of faulty winding, such as irregular winding, can be suppressed. As a result, decrease in the production yield can be suppressed.

In the method for producing a ceramic core, preferably, in the molding step, the molded body including the axial core and the flange portions is formed by pressing ferrite powder by using a lower punch and an upper punch, the ferrite powder including Ni and Zn and being placed in a die, the upper punch having a segmented structure including first upper punches for the flange portions and a second upper punch for the axial core; and in the molding step, movement distances of the lower punch, the first upper punches, and the second upper punch relative to the die are independently controlled so that a ratio t/T of a dimension t of the axial core in a pressing direction after being fired to a dimension T of each of the flange portions in the pressing direction after being fired satisfies 0<t/T≤0.6.

With the production method, the movement distances of the lower punch, the first upper punches for the flange portions, and the second upper punch for the axial core can be independently controlled. Therefore, even when the ceramic core is small and the length L is less than or equal to 1.1 mm, the ceramic core can have a large step between the flange portion and the axial core in the pressing direction. As a result, a ceramic core having a small size and a larger winding region can be produced with a high yield.

The ceramic core, the wire-wound electronic component, and the method for producing a ceramic core according to the present disclosure have an advantage in that decrease in the production yield can be suppressed.

Other features, elements, characteristics and advantages of the present disclosure will become more apparent from the following detailed description of preferred embodiments of the present disclosure with reference to the attached drawings.

DETAILED DESCRIPTION

Figure 1:
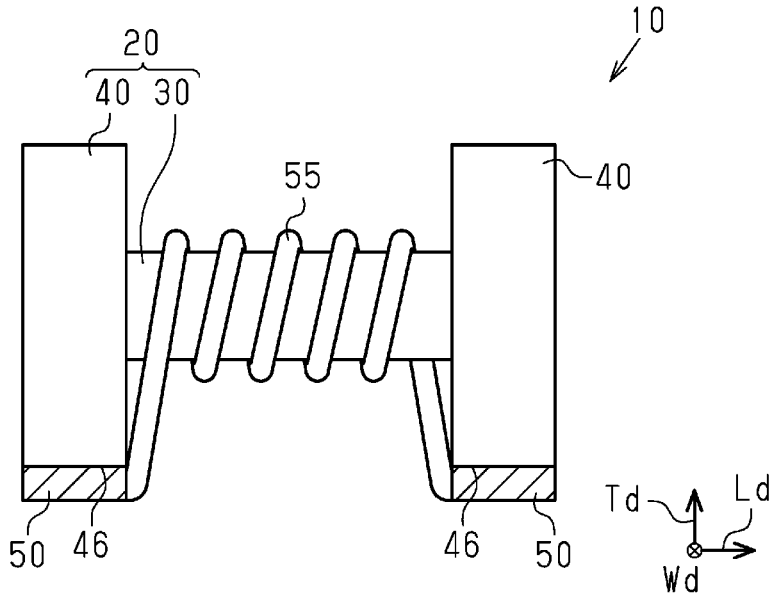
FIG. 1 is a front view of a coil component according to an embodiment.

Hereinafter, an embodiment will be described with reference to the accompanying drawings.

In the accompanying drawings, some elements are magnified to facilitate understanding. The ratios between the dimensions of some elements in some of the drawing differ from the actual ratios or the ratios in other drawings. In some sectional views, some elements are shaded, instead of being hatched, to facilitate understanding.

As illustrated in FIG. 1, a coil component 10 includes a ceramic core 20, electrodes 50, and a wire (coil) 55. The ceramic core 20 is composed of a ferrite material including nickel (Ni) and zinc (Zn). Examples of the ferrite material include a Ni—Zn—Cu ferrite, including Ni, Zn, and copper (Cu) as main components; and a Ni—Zn ferrite, including Ni and Zn as main components.

First, referring to FIG. 2, the structure of the ceramic core 20 will be described.

The ceramic core 20 includes an axial core 30 and a pair of flange portions 40 formed at both ends of the axial core 30. The axial core 30 and the flange portions 40 are integrally formed.

Figure 2:
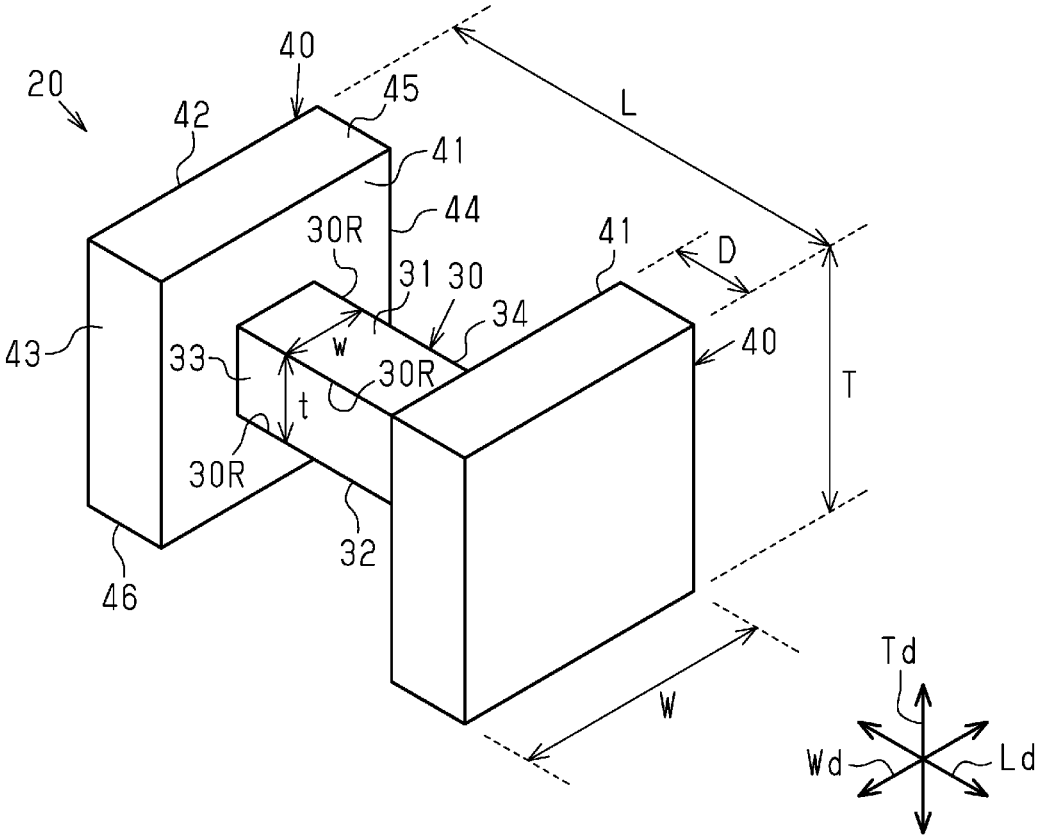
FIG. 2 is a schematic perspective view of a ceramic core according to an embodiment.

In the present specification, as shown in FIGS. 1 and 2, "length direction Ld" is defined as a direction in which the pair of flange portions 40 are arranged; "height direction (thickness direction) Td" is defined as a direction that is perpendicular to the length direction Ld and that is vertical in FIGS. 1 and 2; and "width direction Wd" is defined as a direction that is perpendicular to both of the length direction Ld and the height direction Td.

The axial core 30 has, for example, a rectangular parallelepiped shape extending in the length direction Ld. The axis of the axial core 30 extends substantially parallel to the length direction Ld. The axial core 30 has a pair of main surfaces 31 and 32, which face each other in the height direction Td, and a pair of side surfaces 33 and 34, which face each other in the width direction.

In the present specification, "rectangular parallelepiped shape" includes a rectangular parallelepiped whose corners or ridges are chamfered and a rectangular parallelepiped whose corners or ridges are rounded. Some or all of the main surfaces and the side surfaces may have protrusions and recesses.

The pair of flange portions 40 are disposed at both ends of the axial core 30 in the length direction Ld. Each flange portion 40 has a rectangular parallelepiped shape that is thin in the length direction Ld. Each flange portion 40 projects from the axial core 30 in the height direction Td and the width direction Wd. To be specific, when seen in the length direction Ld, each flange portion 40 has a planar shape that projects from the axial core 30 in the height direction Td and the width direction Wd.

Each flange portion 40 has a pair of main surfaces 41 and 42 that face each other in the length direction Ld, a pair of side surfaces 43 and 44 that face each other in the width direction Wd, and a pair of end surfaces 45 and 46 that face each other in the height direction Td. The main surface 41 of one of the flange portions 40 face the main surface 41 of the other flange portion 40.

The length L of the ceramic core 20 in the length direction Ld is greater than 0 mm and less than or equal to 1.1 mm (that is, L satisfies 0 mm<L≤1.1 mm). Preferably, the length L of the ceramic core 20 satisfies 0 mm<L≤0.85 mm and more preferably 0 mm<L≤0.65 mm. The height T of the ceramic core 20 in the height direction Td (the height of each flange portion 40 in the height direction Td) is, for example, in the range of about 0.1 to 0.6 mm. The width W of the ceramic core 20 in the width direction Wd (the width of each flange portion 40 in the width direction Wd) is, for example, in the range of about 0.1 to 0.6 mm. The thickness t of the axial core 30 in the height direction Td is, for example, in the range of about 0.05 to 0.3 mm. The width w of the axial core 30 in the width direction Wd is, for example, in the range of about 0.05 to 0.3 mm. The thickness D of each flange portion 40 in the length direction Ld is, for example, in the range of about 0.08 to 0.15 mm.

The ratio t/T of the thickness t of the axial core 30 to the height T of each flange portion 40 preferably satisfies 0<t/T≤0.6. More preferably, the ratio t/T is in the range of 0.1 to 0.6 and further preferably in the range of 0.2 to 0.5. The ratio w/W of the width w of the axial core 30 to the width W of each flange portion 40 preferably satisfies 0<w/W≤0.6. More preferably, the ratio w/W is in the range of 0.1 to 0.6 and further preferably in the range of 0.2 to 0.5. By setting the ratio t/T less than or equal to 0.6, the ceramic core 20 can have a large step between the axial core 30 and each flange portion 40 in the height direction Td. By setting the ratio w/W less than or equal to 0.6, the ceramic core 20 can have a large step between the axial core 30 and each flange portion 40 in the width direction Wd. Thus, the ceramic core 20 can have a large winding region (that is, a region in which the wire 55 (see FIG. 1) can be wound).

Ridge portions 30R, which are at the boundaries between the main surfaces 31 and 32 and the side surfaces 33 and 34 of the axial core 30, each have a smooth surface having only small protrusions and recesses. The surface roughness Rz of each ridge portion 30R is less than or equal to 2.5 μm. Preferably, the surface roughness Rz of each ridge portion 30R is in the range of 1.1 to 2.5 μm. When the surface roughness Rz of each ridge portion 30R is less than or equal to 2.5 μm, when winding the wire 55 around the axial core 30 (see FIG. 1), occurrence of faulty winding, such as irregular winding or breakage of the wire 55 or coating detachment, can be suppressed.

The surface roughness Rz, which is called "ten-point-mean roughness", is a parameter representing the roughness of a surface. To be specific, "surface roughness Rz" is defined as follows: a portion of a roughness curve having a reference length in the direction of a mean line of the roughness curve is sampled; and Rz is the sum of the mean of the absolute values of the distances from a mean line of the sampled portion to five highest peaks in the sampled portion and the mean of the absolute values of the distances from the mean line of the sampled portion to five lowest valleys in the sampled portion.

As illustrated in FIG. 1, each electrode 50 is disposed on the end surface 46 of a corresponding one of the flange portions 40 in the height direction Td. The electrodes 50 are electrically connected to electrodes of a circuit board when, for example, the coil component 10 is mounted on a circuit board. The electrodes 50 are made of, for example, a nickel alloy, such as a nickel (Ni)-chrome (Cr) alloy or a Ni-copper (Cu) alloy; silver (Ag); copper (Cu); tin (Sn); or the like.

The wire 55 is wound around the axial core 30. The wire 55 has, for example, a structure in which a core wire, which is mainly composed of a conductive material, such as Cu or Ag, is coated with an insulating material, such as polyurethane or polyester. The wire 55 is, for example, a very thin wire having a diameter of about 20 μm. Each of end portions of the wire 55 is electrically connected to a corresponding one of the electrodes 50.

Next, a method for producing the coil component 10 will be described.

Figure 3:
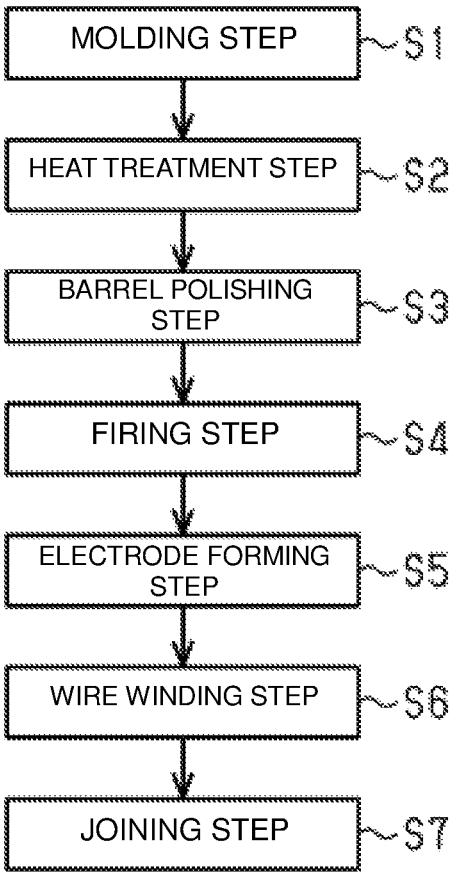
FIG. 3 is a flowchart illustrating a method for producing a coil component according to an embodiment.

First, in step S1 shown in FIG. 3, a ferrite material including Ni and Zn is molded to form a molded body. An example of the molding step will be described below in detail. First, the structure of a powder molding device 60 used in the molding step will be described.

Figure 4B:
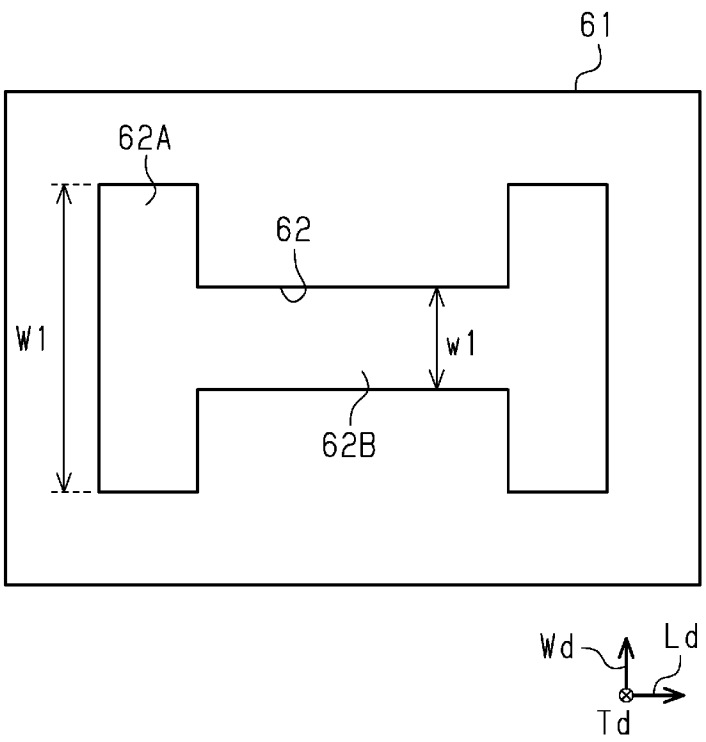
FIG. 4B is a schematic plan view of a die of the powder molding device according to the embodiment.
Figure 4A:
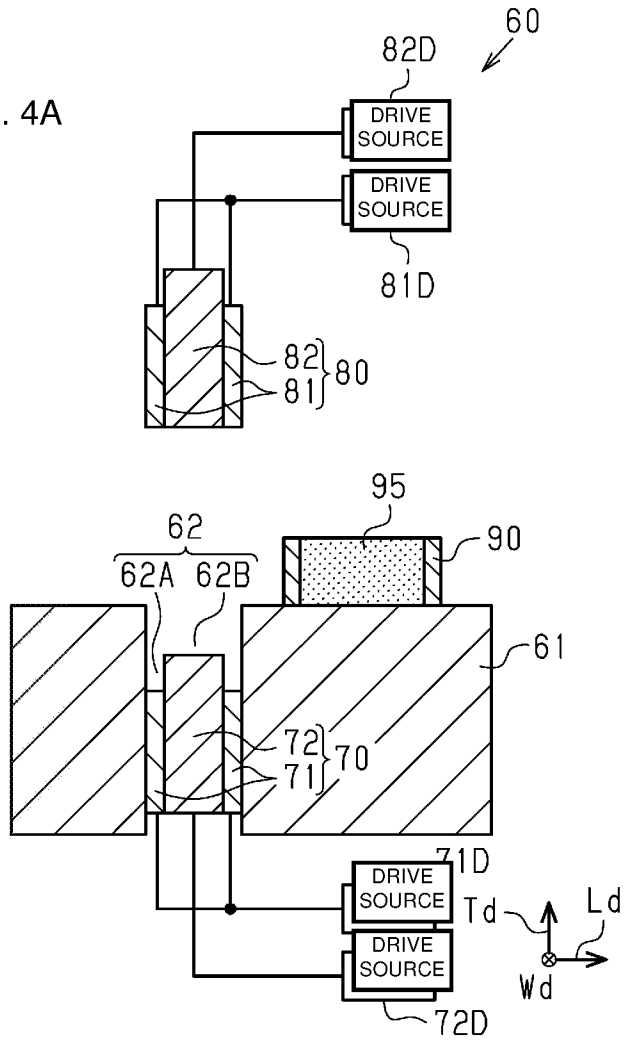
FIG. 4A is a schematic sectional view of a powder molding device according to an embodiment.

As illustrated in FIG. 4A, the powder molding device 60 includes a die 61, a lower punch 70, an upper punch 80, and a feeder 90.

A filling hole 62 extends through the die 61 in the height direction Td. As illustrated in FIG. 4B, when seen in the height direction Td, the filling hole 62 has an "H-shape" that is substantially the same as the shape of the ceramic core shown in FIG. 1. That is, the filling hole 62 includes filling portions 62A, which correspond to the pair of flange portions 40 shown in FIG. 1, and a filling portion 62B, which corresponds to the axial core 30 shown in FIG. 1. The ratio w1/W1 of the width w1 of the filling portion 62B in the width direction Wd to the width W1 of each of the filling portions 62A in the width direction Wd satisfies, for example, 0<w1/W1≤0.6.

As illustrated in FIG. 4A, the lower punch 70 has a segmented structure including first lower punches 71 for the flange portions and a second lower punch 72 for the axial core. The first lower punches 71 and the second lower punch 72 are respectively driven (moved downward or upward) by driving sources 71D and 72D. The upper punch 80 has a segmented structure including first upper punches 81 for the flange portions and a second upper punch 82 for the axial core. The first upper punches 81 and the second upper punch 82 are respectively driven (moved downward or upward) by driving sources 81D and 82D. For example, servo motors can be used as the driving sources 71D, 72D, 81D, and 82D.

The feeder 90 has a box shape. The feeder 90 is disposed on the upper surface of the die 61 so that the feeder 90 can slide over the upper surface in the left-right direction (the length direction Ld).

The powder molding device 60 includes pairs of upper and lower punches, which are pairs of the first lower punches 71 and the first upper punches 81 for the flange portions and a pair of the second lower punch 72 and the second upper punch 82 for the axial core. In the powder molding device 60, the die 61 and the punches 71, 72, 81, and 82 are independently driven. That is, the powder molding device 60 is a multi-axis-press (multi-step-press) powder molding device. The powder molding device 60 performs steps described below. An example of a set-die method, in which molding is performed while fixing the die 61 in place, will be described below.

Figure 5C:
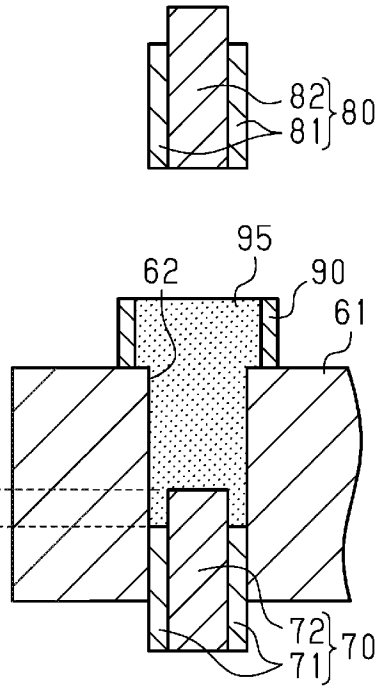
FIGS. 5A to 5C are schematic sectional views illustrating a molding step according to an embodiment.
Figure 5B:
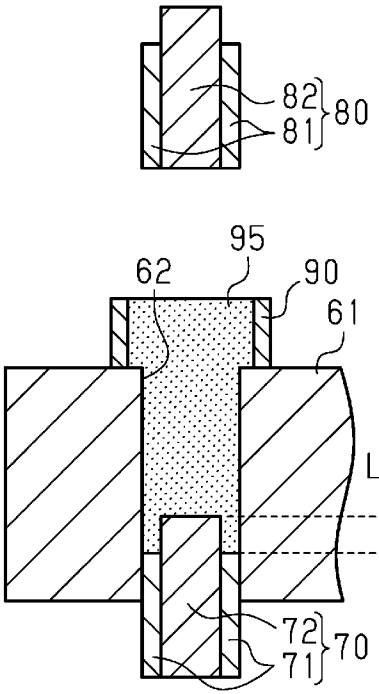
Figure 5A:
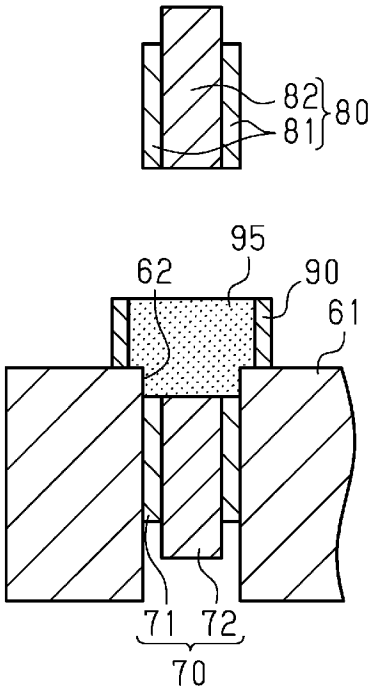

First, in the step shown in FIG. 5A, the feeder 90 is moved to a position above the filling hole 62.

Next, in the step shown in FIG. 5B, ferrite powder 95, which includes Ni and Zn, is supplied from the feeder 90; and the lower punch 70 is moved downward relative to the die 61 by a predetermined distance. To be specific, the first lower punches 71 are moved downward to a position that is lower than a press start position (compression start position) by an overfill distance L1, and the second lower punch 72 is moved downward to a position that is lower than a press start position by an overfill distance L2. Thus, the ferrite powder 95 is supplied from the feeder 90 into a filling space that can contain the ferrite powder 95 by an amount greater than a minimally necessary amount.

The overfill distance L1 may be the same as or different from the overfill distance L2. For example, by making the overfill distance L2 greater than the overfill distance L1, a part of the filling space corresponding to the flange portions 40 can have a larger volume.

Next, in the step shown in FIG. 5C, the first lower punches 71 and the second lower punch 72 are respectively moved upward by the overfill distances L1 and L2 relative to the die 61, so that the first and second lower punches 71 are moved to the press start positions (overfill). Thus, an excessive portion of the ferrite powder 95 is pushed back into the feeder 90, and therefore the filling hole 62 is densely filled with the ferrite powder 95.

The overfilling step shown in FIGS. 5B and 5C may be omitted. In this case, the first lower punches 71 and the second lower punch 72 are moved to the press start positions from the positions shown in FIG. 5A.

Figure 6B:
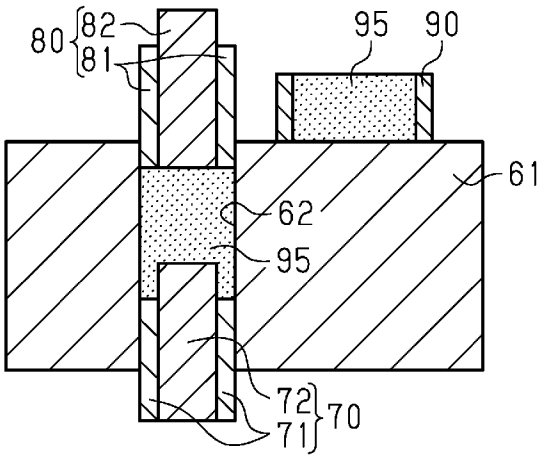
FIGS. 6A and 6B are schematic sectional views illustrating the molding step according to the embodiment.
Figure 6A:
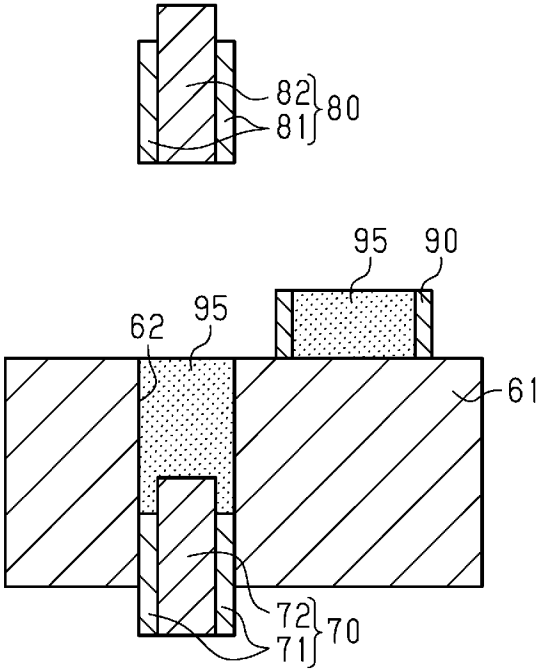

Next, in the step shown in FIG. 6A, the feeder 90 is moved backward in the rightward direction in FIG. 6A. At this time, the ferrite powder 95 that has run over the filling hole 62 is levelled off by side walls of the feeder 90 and the like.

Next, in the step shown in FIG. 6B, the upper punch 80 is moved downward into the filling hole 62. At this time, in order to suppress discharge of the ferrite powder 95 from the filling hole 62, the lower punch 70 may be moved downward relative to the die 61 before inserting the upper punch 80 into the filling hole 62 (underfill).

Figure 7A:
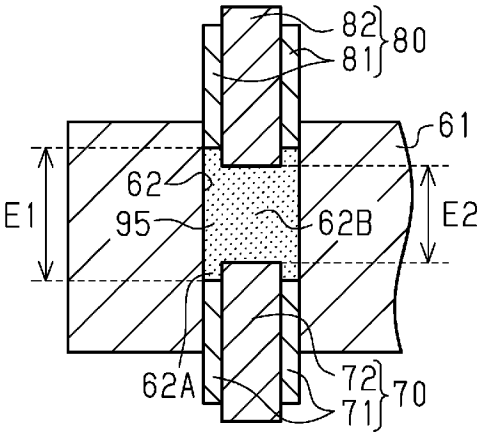
FIGS. 7A to 7C are schematic sectional views illustrating the molding step according to the embodiment.

Next, in the step shown in FIG. 7A, the punches 71, 72, 81, and 82 are transferred to the press start positions (transfer step). Next, in the step shown in FIG. 7B, the ferrite powder 95, which has been placed into the filling space surrounded by the upper punch 80, the lower punch 70, and the die 61, is molded to form a molded body 20A by pressing the ferrite powder 95 by using the lower punch 70 and the upper punch 80 (pressing step). For example, the ferrite powder 95 is pressed by moving the first and second lower punches 71 and 72 upward relative to the die 61 and moving the first and second upper punches 81 and 82 downward relative to the die 61.

In this step, the compression ratio (molding density) of the molded body 20A is determined by the filling depth of the ferrite powder 95 before being molded and the thickness of the molded body 20A after being molded (or the total movement distance of the lower punch 70 and the upper punch 80 during press molding). In the present specification, "compression ratio" is defined as the ratio of the thickness of the molded body 20A after being molded to the filling depth of the ferrite powder 95 before being molded. As illustrated in FIG. 7A, "filling depth E1" is defined as the depth of the ferrite powder 95 placed in the filling portions 62A between the first lower punches 71 and the first upper punches 81 at the press start positions. Likewise, "filling depth E2" is defined as the depth of the ferrite powder 95 placed in the filling portion 62B between the second lower punch 72 and the second upper punch 82 at the press start positions. Therefore, the compression ratio R1 of each flange portion 40 is equal to the ratio T1/E1 of the dimension T1 (see FIG. 7B) of each flange portion 40 in the pressing direction (vertical in FIG. 7B) after being molded to the filling depth E1. Likewise, the compression ratio R2 of the axial core 30 is equal to the ratio t1/E2 of the dimension t1 (see FIG. 7B) of the axial core 30 in the pressing direction after being molded to the filling depth E2.

Figure 7B:
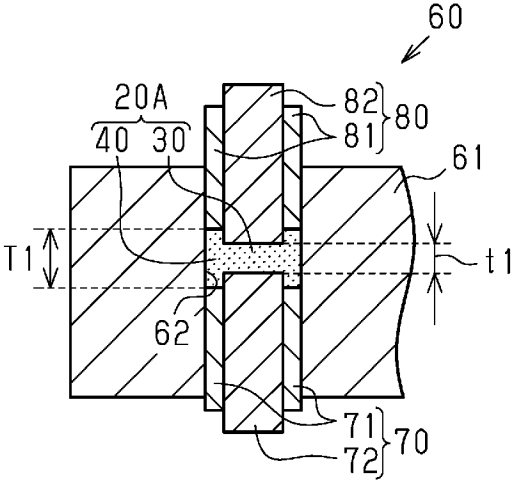

Because the powder molding device 60 can independently drive the punches 71, 72, 81, and 82, the powder molding device 60 can independently control the movement distances of the punches 71, 72, 81, and 82 relative to the die 61. Therefore, the powder molding device 60 can independently adjust the press start positions of the punches 71, 72, 81, and 82, and can independently adjust the movement distances of the punches 71, 72, 81, and 82 during pressing. Thus, the powder molding device 60 can independently adjust the filling depths E1 and E2, which are shown in FIG. 7A, and can independently adjust the dimension T1 of each flange portion 40 and the dimension t1 of the axial core 30, which are shown in FIG. 7B. Therefore, the powder molding device 60 can appropriately form the molded body 20A, which is small and which has a large step between the axial core and each flange portion 40 in the pressing direction. Moreover, the difference in molding density between the axial core 30 and each flange portion 40 can be reduced.

For example, in the transfer step and the pressing step according to the present embodiment, the movement distances of the punches 71, 72, 81, and 82 are independently controlled so that the ratio t1/T1 of the dimension t1 of the axial core 30 in the pressing direction to the dimension T1 of each flange portion 40 in the pressing direction satisfies $0<t1/T1\leq 0.6$. The movement distances of the punches 71, 72, 81, and 82 are independently controlled so that the ratio t/T of the thickness t of the axial core 30 after being fired to the height T of each flange portion 40 after being fired, which will be described below, satisfies $0<t/T\leq 0.6$.

Moreover, in the transfer step and the pressing step according to the present embodiment, the movement distances of the punches 71, 72, 81, and 82 are independently controlled so that the compression ratio R1 of each flange portion 40 is equal to the compression ratio R2 of the axial core 30. The ratio R1/R2 of the compression ratio R1 of each flange portion 40 to the compression ratio R2 of the axial core 30 is preferably in the range of 0.9 to 1.1 and more preferably in the range of 0.95 to 1.05. By setting the ratio R1/R2 in the range of 0.9 to 1.1, the difference in molding density between the axial core 30 and each flange portion 40, which have different thicknesses in the pressing direction, can be reduced.

Figure 7C:
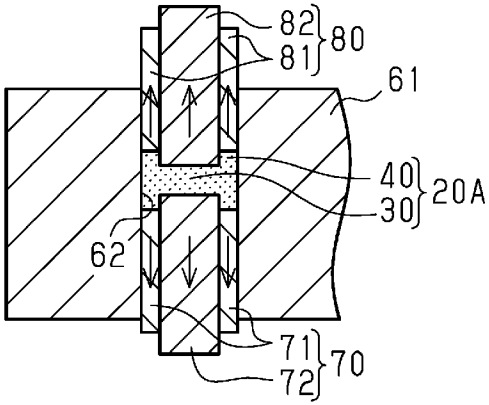

Next, in the step shown in FIG. 7C, after the molded body 20A has been formed, pressure is reduced to such an extent that the lower punch 70 and the upper punch 80 are not separated from the molded body 20A. To be specific, pressure applied to the molded body 20A is reduced to such an extent that the lower punch 70 and the upper punch 80 are not separated from the molded body 20A. This depressurizing step is performed while the molded body 20A is in the die 61. In this step, if pressure is reduced to such an extent that the lower punch 70 and the upper punch 80 are separated from the molded body 20A, a problem occurs in that the molded body 20A expands and breaks. This step (depressurizing step) may be omitted.

Figure 8C:
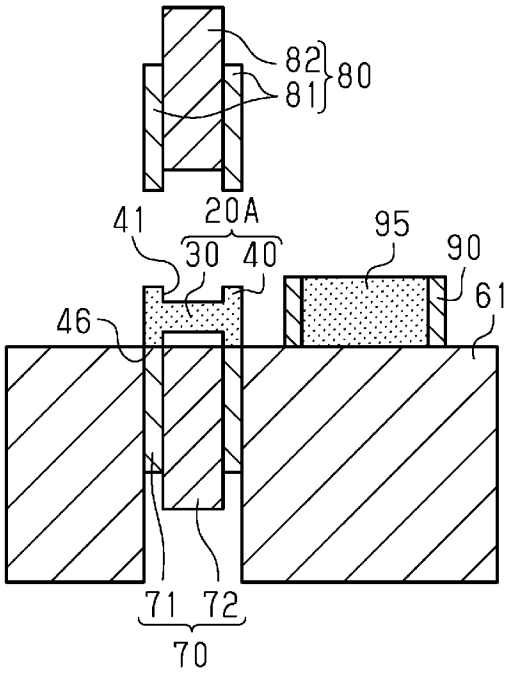
FIGS. 8A to 8C are schematic sectional views illustrating the molding step according to the embodiment.
Figure 8B:
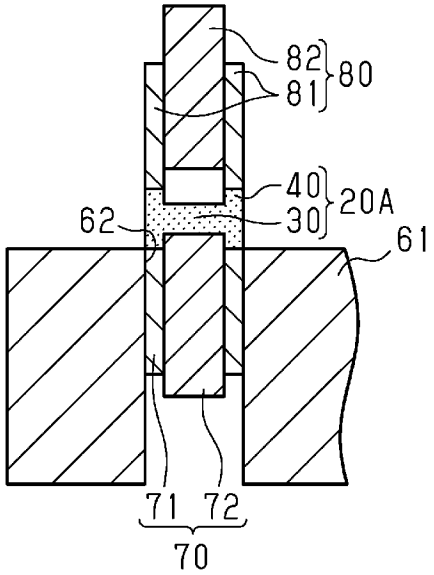
Figure 8A:
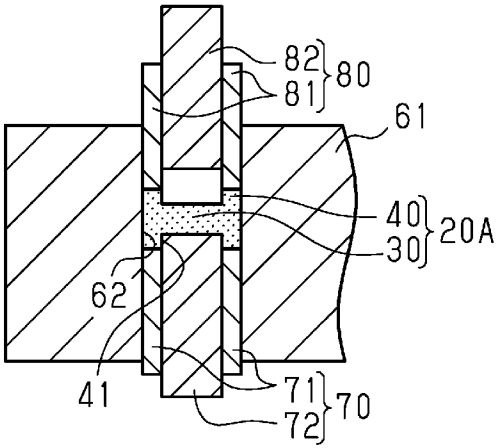

Next, in the step shown in FIG. 8A, only the second upper punch 82 of the upper punch 80, for the axial core, is moved upward, so that the second upper punch 82 is separated from the molded body 20A before the first upper punches 81 are. Thus, the second upper punch 82 can be moved upward while the lower surfaces of the first upper punches 81 are in contact with the flange portions 40, that is, while upward movement of the molded body 20A is restricted by the first upper punches 81. Therefore, the molded body 20A can be prevented from moving upward (being lifted) together with the second upper punch 82 while adhering to the second upper punch 82.

Next, in the step shown in FIG. 8B, the molded body 20A is removed from the die 61 by moving the lower punch 70 and the upper punch 80 upward relative to the die 61 (demolding step). Note that the aforementioned step of separating only the second upper punch 82 from the molded body 20A may be performed after this demolding step.

Next, in the step shown in FIG. 8C, the second lower punch 72 is moved downward, and the first upper punches 81 and the second upper punch 82 are moved upward (release step). Thus, the second lower punch 72 is separated from the molded body 20A, and the first upper punches 81 are separated from the molded body 20A. At this time, because the second upper punch 82 has been separated from the molded body 20A in the previous step, when separating the first upper punches 81 from the molded body 20A, the total area of contact between the molded body 20A and the upper punch 80 is small. Thus, the molded body 20A can be prevented from being lifted together with the first upper punches 81.

In this step, the timing at which the second lower punch 72 is moved downward and the timing at which the upper punch 80 is moved upward are not particularly limited. For example, the upper punch 80 may be moved upward at the same time as the second lower punch 72 is moved downward. The upper punch 80 may be moved upward after the second lower punch 72 has been moved downward. The second lower punch 72 may be moved downward after the upper punch 80 has been moved upward.

Subsequently, the feeder 90 is moved (forward) in the leftward direction in FIG. 8C to push out the molded body 20A. Thus, the molded body 20A is collected by an external collection unit. Through the production process described above, the molded body 20A, which has substantially the same shape as the ceramic core 20 shown in FIG. 2, is produced.

The molding step described above can be performed in a similar way by using a floating-die method. In the floating-die method, for example, the first lower punches 71 are fixed in place; and the die 61, the second lower punch 72, and the upper punch 80 are moved up and down. In this case, for example, by moving the die 61 upward, the first lower punches 71 can be moved downward relative to the die 61. By moving the die 61 downward, the first lower punches 71 can be moved upward relative to the die 61.

Next, referring to FIG. 3, a method for producing the coil component 10 after the molding step will be schematically described.

First, in step S2, the molded body 20A is heat-treated. In the present specification, a structure after being heat-treated will be referred to as a "calcined body". That is, in step S2, the molded body 20A is heat-treated to obtain a calcined body. Next, the calcined body is barrel-polished (step S3). In the barrel polishing, the calcined body is placed in a barrel and polished by using an abrasive. Due to the barrel polishing, burr is removed from the calcined body, and the outer surface of the calcined body (in particular, corners and ridges) becomes rounded. At this time, a microcrack might appear in the calcined body due to barrel polishing. The barrel polishing may be dry barrel polishing or wet barrel polishing.

Next, the calcined body, after being barrel-polished, is fired in a firing furnace at a predetermined temperature (about 1100° C.) for a predetermined time (for example, one hour) (step S4). Through the process described above, the ceramic core 20 shown in FIG. 2 is produced. In the present specification, a structure after being fired will be referred to as a "sintered body".

Next, the electrodes 50 are formed on the end surfaces 46 of the flange portions 40 of the ceramic core 20 (step S5). For example, the electrodes 50 can be formed by applying an electrically conductive paste, which is made of Ag or the like, to the end surfaces 46 of the flange portions 40; baking the electrically conductive paste to form an underlying metal layer; and then alternately forming a nickel (Ni) plating layer and a tin (Sn) plating layer on the underlying metal layer by using an electroplating method.

Next, the wire 55 is wound around the axial core 30 of the ceramic core 20 (step S6). Then, the end portions of the wire 55 and the electrodes 50 are joined to each other by using a known method, such as thermocompression bonding (step S7). Through the process described above, the coil component 10 is produced.

Next, the heat treatment step (step S2) will be described in detail.

Due to heat treatment in the heat treatment step, powder grains (material grains) of the molded body 20A are sintered to some extent, and densification of the molded body 20A progresses. Thus, the strength of the structure after being heat-treated (that is, the calcined body) becomes higher than that before being heat-treated. Here, "sintering" refers to a process in which the molded body 20A is heated and the powder grains of the molded body 20A cause surface diffusion (adhesion or fusion) to change into a polycrystal. During the sintering, as the powder grains cause surface diffusion, grain growth also occurs, and the crystal grains of the molded body 20A grow. In this step, heat treatment is performed so that sintering of the calcined body does not proceed to the final state (that is, a state after the firing step).

In the heat treatment step, heat treatment is performed so that the ratio D1/D2 of the average grain diameter D1 of the structure after being heat-treated (that is, the calcined body) to the average grain diameter D2 of the after being fired (that is, the sintered body) is in the range of 0.1 to 0.5 (preferably, 0.15 to 0.5). The average grain diameters D1 and D2 are each calculated, for example, as follows: images of a plurality of (for example, five) portions of the surface of the calcined body and the sintered body are captured by using a scanning electron microscope; the grain diameters of a plurality of (for example, 200) crystal grains in the captured images are converted into equivalent circle diameters; and the average of the equivalent circle diameters is calculated.

By setting the ratio D1/D2 in the range of 0.1 to 0.5, barrel polishing in the next step (step S3) can be performed in a state in which the grain diameter of the crystal grains is less than that of the crystal grains after being fired. If the sintered body is barrel-polished, the surface roughness Rz of the sintered body after being barrel-polished is large. Presumably, this is because, if the sintered body, which has a large grain diameter, is barrel-polished, the surface roughness Rz of the sintered body increases as the large crystal grains come off during barrel polishing. In this case, the surface roughness Rz of each ridge portion 30R of the axial core 30 also increases. Then, when winding the wire 55 around the axial core 30, the winding pitch varies due to protrusions and recesses of the ridge portions 30R, and irregular winding of the wire 55 is likely to occur. Moreover, due to the protrusions and recesses of the ridge portion 30R, faulty winding, such as breakage of the wire 55 or detachment of a coating of the wire 55, is likely to occur. Such faulty winding is particularly likely to occur when the wire 55 is a very thin wire having a diameter of about 20 μm.

In contrast, by setting the ratio D1/D2 in the range of 0.1 to 0.5, barrel polishing can be performed in a state in which the grain diameter of the crystal grains of the calcined body is comparatively small. Therefore, compared with a case where barrel polishing is performed on the sintered body, the surface roughness Rz of the outer surface of (in particular, corners and ridges) of the calcined body after being barrel-polished can be reduced. Moreover, because firing is performed after barrel polishing, the outer surface of the ceramic core 20 (that is, the sintered body) can be made smoother by the firing. To be specific, the surface roughness Rz of each ridge portion 30R of the axial core 30 of the ceramic core 20 can be reduced. Thus, even if the wire 55, which is to be wound around the axial core 30, is a very thin wire having a diameter of about 20 μm, occurrence of faulty winding, such as irregular winding or breakage of the wire 55 or coating detachment, can be suppressed.

By performing heat treatment so that the ratio D1/D2 is in the range of 0.1 to 0.5, appropriate strength (to be specific, strength for avoiding a fault, such as breakage or chipping, during barrel polishing) can be provided to the calcined body after being heat-treated. In particular, by setting the ratio D1/D2 in the range of 0.15 to 0.5, sufficient strength can be provided to the calcined body. Thus, occurrence of a fault, such as breakage or chipping of the calcined body, during barrel polishing can be suppressed.

Moreover, by setting the ratio D1/D2 in the range of 0.1 to 0.5, in the firing step (step S4), which is subsequently performed, sintering and grain growth can be sufficiently promoted. For example, when the ratio D1/D2 is 0.5, grain growth of the crystal grains proceeds by about 50% in the heat treatment step, and the remaining 50% of the grain growth can be promoted in the firing step. Thus, even if a microcrack appears in the calcined body due to barrel polishing, by promoting sintering and grain growth of the calcined body in the firing step, the microcrack can be appropriately filled (necked). As a result, the strength (for example, the flexural strength) of the ceramic core 20 after being fired can be increased.

If the ratio D1/D2 is less than 0.1, sintering and densification of the calcined body proceeds to only a slight degree, and the strength of the calcined body is low. Therefore, if the ratio D1/D2 is less than 0.1, a fault, such as breakage or chipping of the calcined body, is likely to occur due to barrel polishing.

On the other hand, if the ratio D1/D2 is greater than 0.5, the grain diameter of the calcined body during barrel polishing is large. Therefore, the surface roughness Rz of the outer surface of the calcined body after being barrel-polished is large, and the surface roughness Rz of the outer surface of the ceramic core 20 after being fired is large. As a result, if the ratio D1/D2 is greater than 0.5, faulty winding is likely to occur as in the case where barrel polishing is performed on the sintered body.

Moreover, if the ratio D1/D2 is greater than 0.5, the strength of the calcined body is excessively high, so that burr cannot be sufficiently removed by barrel polishing. If burr remains in the ceramic core 20, faulty winding is likely to occur. As the size of the ceramic core 20 (the calcined body) decreases, a force applied to the ceramic core 20 during barrel polishing decreases, so that the problem that burr cannot be removed becomes more significant.

Moreover, if the ratio D1/D2 is greater than 0.5, the potential of grain growth in the firing step is limited, so that it is difficult to fill a microcrack that has appeared due to barrel polishing. Due to the microcrack that remains in the ceramic core 20, the strength of the ceramic core 20 is reduced.

Heat treatment conditions in this step include, for example, heat treatment temperature (highest temperature), heat treatment time (retention time), heat treatment atmosphere, and temperature-increasing speed. For example, by controlling the heat treatment temperature and the heat treatment time, the ratio D1/D2 can be appropriately adjusted to the range of 0.1 to 0.5. The heat treatment temperature is set lower than the firing temperature (for example, 1100° C.) in the firing step, and the heat treatment time is set shorter than the retention time in the firing step (for example, one hour). In the present embodiment, the heat treatment temperature is preferably in the range of 900 to 1075° C. and more preferably in the range of 1000 to 1075° C. Preferably, the heat treatment time is about ten minutes. The average grain diameter of the calcined body, which has been heat-treated under such conditions, is preferably in the range of about 0.8 to 4 μm and more preferably in the range of about 1.2 to 4 μm.

Moreover, in the present embodiment, the process conditions in the heat treatment step (step S2), the barrel polishing step (step S3), and the firing step (step S4) are set so that the surface roughness Rz of each ridge portion 30R of the axial core 30 of the sintered body (that is, the ceramic core 20), which is obtained by firing, is less than or equal to 2.5 μm. By setting the surface roughness Rz of each ridge portion 30R as described above, faulty winding can be effectively suppressed. Examples of process conditions of the barrel polishing step include the type of barrel polishing (the type of the abrasive) and grinding time. Examples of process conditions of the firing step include firing temperature, firing time (retention time), firing atmosphere, and temperature-increasing speed.

The present embodiment described above has the following advantages.

(1) The surface roughness Rz of each ridge portion 30R of the axial core 30 is less than or equal to 2.5 μm. Thus, because the surfaces of the ridge portions 30R are smooth surfaces having only small protrusions and recesses, when the wire 55 is wound around the axial core 30, occurrence of faulty winding, such as irregular winding, breakage, or coating detachment of the wire 55 can be suppressed.

(2) The ceramic core 20 is produced by heat-treating the molded body 20A to obtain the calcined body; barrel-polishing the calcined body; and firing the calcined body after being barrel-polished. The heat treatment is performed so that the ratio D1/D2 of the average grain diameter D1 after heat treatment to the average grain diameter D2 after firing is in the range of 0.1 to 0.5. Therefore, barrel polishing can be performed in a state in which the grain diameter of the crystal grains of the calcined body is smaller than the grain diameter of crystal grains after being fired. Thus, compared with a case where barrel polishing is performed on the sintered body, the surface roughness Rz of the calcined body after being barrel-polished can be reduced. Moreover, because firing is further performed after barrel polishing, the surface of the ceramic core 20 after being fired can be made smoother. Thus, when the wire 55 is wound around the axial core 30 of the ceramic core 20, occurrence of faulty winding, such as irregular winding or breakage of the wire 55 or coating detachment, can be suppressed. As a result, decrease in the production yield can be suppressed.

(3) Barrel polishing is performed after increasing the strength of the calcined body from the strength before heat treatment by performing heat treatment. Therefore, occurrence of a fault, such as breakage or chipping of the calcined body, during barrel polishing can be suppressed. As a result, decrease in the production yield can be suppressed.

(4) Moreover, because firing is performed after barrel polishing, even if a microcrack appears in the calcined body due to barrel polishing, the microcrack can be filled during firing. Thus, the strength (for example, the flexural strength) of the ceramic core 20 after being fired can be increased.

(5) In the ceramic core 20, the length L is set less than or equal to 1.1 mm, the ratio t/T is set less than or equal to 0.6, and the ratio w/W is set less than or equal to 0.6. Thus, the step between the axial core 30 and each flange portion 40 in the height direction Td and the width direction Wd can be increased. Therefore, the ceramic core 20 has a small size and a large winding region.

(6) Because the ceramic core 20 has a large winding region, the number of turns of the wire 55 of the coil component 10 can be increased. Thus, the inductance of the coil component 10 can be increased. Moreover, the diameter of the wire 55 can be increased. In this case, the direct-current resistance of the coil component 10 can be reduced.

(7) In order to improve the characteristics (increase the inductance) of the coil component 10 having a small size, the dimensions of the ceramic core 20 are set so that the ratio t/T, the ratio w/W, and the thickness D are small. Therefore, in the ceramic core 20, the thickness t and width w of the axial core 30 are small, and the thickness D of each flange portion 40 is small. When the dimensions of the coil component 10 are set in this way, the axial core 30 has a small diameter and the flange portions 40 are thin. Therefore, breakage or chipping of the calcined body is likely to occur during barrel polishing. In this case, for example, by setting the ratio D1/D2 in the range of 0.15 to 0.5, sufficient strength can be provided to the calcined body after being heat-treated. Thus, even when the calcined body, which is small and includes the axial core 30 that is thin and the flange portions 40 each having a small thickness, is barrel-polished, occurrence of breakage or chipping of the calcined body during the barrel polishing can be effectively suppressed.

(8) In the molding step (step S1), the following problems arise if the molded body 20A is formed by using a single-axis press (single press), which uses a single-axis punch in which a portion corresponding to the axial core 30 and portions corresponding to the flange portions 40 are integrated. To be specific, when a single-axis press is used, if the thickness of the axial core 30 and the thickness of each flange portion 40 in the pressing direction differ from each other, the compression ratio of a thicker one of the flange portions 40 becomes less than the compression ratio of the axial core 30. The difference in compression ratio increases as the step between the axial core 30 and each flange portion 40 in the pressing direction increases. Accordingly, as the step between the axial core 30 and each flange portion 40 in the pressing direction increases, a problem arises in that the molding density of the flange portions 40 decreases and the strength of the flange portions 40 decreases. In particular, in a case of producing a ceramic core in which the length L is less than or equal to 1.1 mm and the ratio t/T is less than or equal to 0.6, the strength of the flange portions 40 decreases considerably. Then, chipping of the flange portions 40 occurs during press molding and the molded body cannot be formed. Therefore, when a single-axis press is used, a molded body having a large step between the axial core 30 and each flange portion 40 cannot be molded.

In contrast, in the production method according to the present embodiment, the molded body 20A is formed by pressing the ferrite powder 95, which is placed into the die 61, by using the lower punch 70 and the upper punch 80. The lower punch 70 has a segmented structure including the first lower punches 71 for the flange portions and the second lower punch 72 for the axial core. The upper punch 80 has a segmented structure including the first upper punches 81 for the flange portions and the second upper punch 82 for the axial core. The punches 71, 72, 81, and 82 are independently driven, and the movement distances of the punches 71, 72, 81, and 82 are independently controlled. Therefore, the press start positions of the punches 71, 72, 81, and 82 can be independently adjusted; and the movement distances of the punches 71, 72, 81, and 82 during pressing can be independently adjusted. Thus, the compression ratio R1 of the flange portions 40 and the compression ratio R2 of the axial core 30 can be independently adjusted. Therefore, even if the step between the axial core 30 and each flange portion 40 in the pressing direction is large, decrease of the molding density of the flange portions 40 can be suppressed, and decrease of the strength of the flange portions 40 can be suppressed. Accordingly, with the production method according to the present embodiment, even when the length L is small and less than or equal to 1.1 mm, the molded body 20A, in which the step between each flange portion 40 and the axial core 30 in the pressing direction is large (that is, the ratio t/T is low), can be formed. As a result, the ceramic core 20, which has a small size and a large winding region, can be produced with a high yield.

(9) The movement distances of the punches 71, 72, 81, and 82 are independently controlled so that the compression ratio R1 of each flange portion 40 is equal to the compression ratio R2 of the axial core 30. Thus, the difference in molding density between the axial core 30 and each flange portion 40, which have different thicknesses in the pressing direction, can be reduced.

Modifications

The embodiment described above may be modified as follows.

Figure 9:
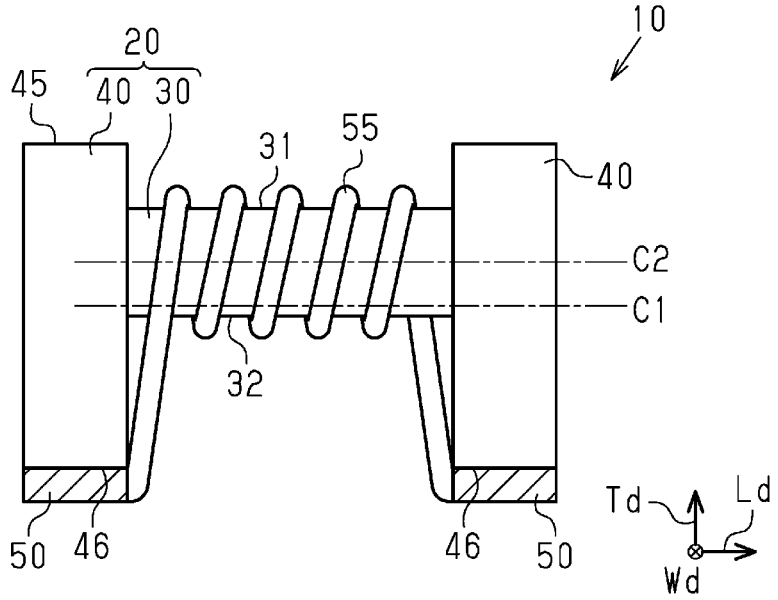
FIG. 9 is a front view of a coil component according to a modification.

As illustrated in FIG. 9, the axial core 30 may be offset from the center C1 of each flange portion 40 in the height direction Td. To be specific, the center C2 of the axial core 30 in the height direction Td may be offset from the center C1 of each flange portion 40 in the height direction Td. For example, the axial core 30 is offset from the center C1 of each flange portion 40 toward the end surfaces 45.

In this case, preferably, the electrodes 50 are formed on the end surfaces 46 of the flange portions 40. That is, preferably, the electrodes 50 are formed on the end surfaces 46, which are disposed in a direction from the center C1 opposite to the direction (upward direction in FIG. 9) in which the axial core 30 is offset. Thus, compared with a case where the center C2 of the axial core 30 coincides with the center C1 of each flange portion 40, the axial core 30 and the electrodes 50 can be separated from each other by a larger distance. Accordingly, the electrodes 50 can be formed in a larger area. As a result, occurrence of a faulty joint between the electrodes 50 and the wire 55 or the like can be suppressed, and decrease in the production yield can be suppressed.

Moreover, the wire 55 (coil), which is wound around the axial core 30, can be separated from the electrodes 50 by a larger distance. Therefore, occurrence of a short circuit between the wire 55, which is wound around the axial core 30, and the electrodes 50 can be effectively suppressed. As a result, decrease in the production yield can be suppressed.

Moreover, for example, when the coil component 10 is mounted on a circuit board, the wire 55, which is wound around the axial core 30, can be separated from a circuit pattern on the circuit board. Thus, the wire 55 of the coil component 10 is not likely to generate an eddy current in the circuit pattern. As a result, increase of eddy-current loss can be suppressed, and decrease of Q-value can be suppressed.

Figure 10:
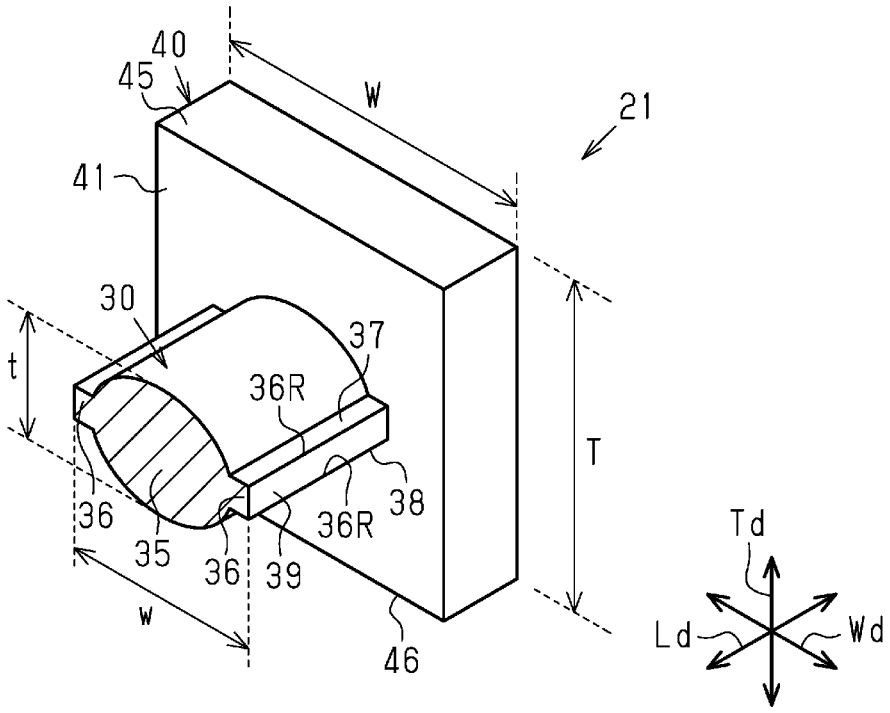
FIG. 10 is a sectional perspective view of a ceramic core according to a modification.

As illustrated in FIG. 10, the axial core 30 may have a substantially elliptical or substantially circular shape in a cross section perpendicular to the axis of the axial core 30 (the length direction Ld). To be specific, the axial core 30 includes a body 35 and protruding portions 36. The cross-sectional shape of the body 35 in a direction perpendicular to the axis of the axial core 30 is substantially elliptical or substantially circular. The protruding portions 36 protrude from both ends of the body 35 in the width direction Wd, and the cross-sectional shape of each of the protruding portions 36 is substantially rectangular. The protruding portions 36 each have main surfaces 37 and 38, which face each other in the height direction Td, and a side surface 39. The protruding portions 36 are formed to prevent breakage of a punch in a production process.

In the axial core 30, ridge portions 36R, which are boundaries between the main surfaces 37 and 38 and the side surfaces 39 of the protruding portions 36, are smooth surfaces having only small protrusions and recesses. The surface roughness Rz of each ridge portion 36R is less than or equal to 2.5 μm. Preferably, the surface roughness Rz of each ridge portion 36R is in the range of 1.1 to 2.5 μm.

In a ceramic core 21 according to the present modification, the cross section of the axial core 30 perpendicular to the length direction Ld is substantially elliptical. Therefore, the wire 55 (see FIG. 1) can be easily wound around the axial core 30, and breakage of the wire 55 when wound around the axial core 30 can be suppressed. As a result, decrease in the production yield can be effectively suppressed.

Preferably, the ratio t/T of the largest dimension t of the axial core 30 in the height direction Td to the height T of each flange portion 40 satisfies $0<t/T\leq 0.6$. Preferably, the ratio w/W of the largest dimension w of the axial core 30 in the width direction Wd to the width W of each flange portion 40 satisfies $0<w/W\leq 0.6$.

Figure 11:
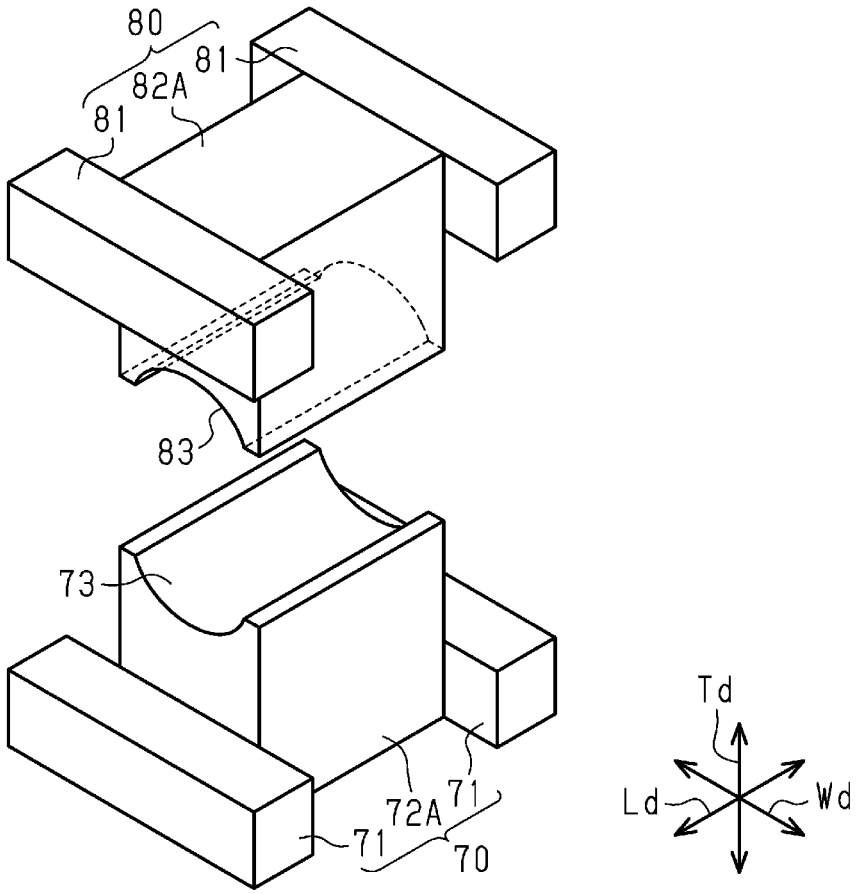
FIG. 11 is a schematic perspective view of a powder molding device according to the modification.

A molded body having the same shape as the ceramic core 21 described above can be produced by using a lower punch 70 and an upper punch 80 shown in FIG. 11. The lower punch 70 is a segmented punch including first lower punches 71 for the flange portions and a second lower punch 72A for the axial core. A groove 73 is formed in an upper surface of the second lower punch 72A. The groove 73 has a concave cylindrical inner surface corresponding to the body 35 of the axial core 30. The upper punch 80 is a segmented punch including first upper punches 81 for the flange portions and the second upper punch 82A for the axial core. A groove 83 is formed in a lower surface of the second upper punch 82A. The groove 83 has a concave cylindrical inner surface corresponding to the body 35 of the axial core 30.

In the embodiment, the planar shape of each flange portion 40 seen in the length direction Ld is a quadrangle. However, this is not a limitation. For example, the planar shape of each flange portion 40 seen in the length direction Ld may be a polygon other than a quadrangle.

In each flange portion 40 according to the embodiment, the ridge portions of the end surfaces 46, on which the electrodes 50 are formed, may be chamfered. In this case, when joining the end portions of the wire 55 to the electrodes 50 by thermocompression bonding or the like, breakage of the wire 55 can be suppressed. As a result, decrease in the production yield can be suppressed.

The shape of the ceramic core 20 according to the embodiment is not particularly limited. The shape of the ceramic core 20 is not particularly limited, as long as the wire 55 can be wound around the ceramic core 20. For example, the shape of the ceramic core 20 may be changed to a shape in which the ratio w/W is 1.

The embodiment described above is the coil component 10 including the ceramic core 20 or 21. However, an embodiment may be a wire-wound electronic component (for example, antenna) other than a coil component.

In the embodiment, the positions of the electrodes 50 may be changed as necessary. For example, the electrodes 50 may be formed on the side surfaces 43 or the side surfaces 44 of the flange portion 40.

In the embodiment, the lower punch 70 may be changed to a single-axis punch in which a portion corresponding to the axial core 30 and portions corresponding to the flange portions 40 are integrated.

In the embodiment, both of the lower punch 70 and the upper punch 80 may be changed to single-axis punches in each of which a portion corresponding to the axial core 30 and portions corresponding to the flange portions 40 are integrated.

In the embodiment, a molding method used in the molding step (step S1) is not particularly limited. Instead of using a dry molding method described in the embodiment, the molded body 20A may be formed by using, for example, a wet molding method or an extrusion molding method.

The embodiment and the modifications described above may be used in combination.

EXAMPLES

Next, the embodiment and the modifications will be more specifically described by using Examples and Comparative examples.

Examples 1 to 5

The molded body 20A was produced by using the production method according to the embodiment. At this time, the ferrite powder 95, which is the material powder, was made as described below. First, a Ni—Zn—Cu ferrite material was prepared, and slurry was made by adding an organic binder, a dispersing agent, and pure water to the ferrite material. Next, the slurry was dried and granulated by using a spray dryer. Then, the ferrite powder 95 was made by causing the grains to pass through a sieve having a hole size of 0.18 mm so that the average grain diameter $D_{50}$ was adjusted to 50 μm. The molded body 20A was made by press-molding the ferrite powder 95 by using the powder molding device 60. At this time, the target values (design values) of the dimensions of the ceramic core 20 after being fired were set as follows.

Length L of the ceramic core 20: 0.51 mm
Width W of the ceramic core 20: 0.38 mm
Height T of the ceramic core 20: 0.38 mm
Thickness D of each flange portion 40: 0.095 mm
Thickness t of the axial core 30: 0.225 mm
Width w of the axial core 30: 0.19 mm Therefore, the target value of the ratio t/T of the thickness t to the height T was 0.59, and the target value of the ratio w/W of the width w to the width W was 0.5.

Next, the molded body 20A was placed in a sagger made of zirconia ($ZrO_2$), the sagger was placed in a firing furnace, and heat treatment was performed. In the heat treatment, the temperature in the firing furnace was increased to 900° C. (Examples 1), 950° C. (Examples 2), 1000° C. (Examples 3), 1050° C. (Examples 4), and 1075° C. (Examples 5), and the molded body 20A was retained for ten minutes after the temperature had been increased.

Next, the heat-treated sample (calcined body) and pure water were placed into a container, and barrel polishing was performed for 30 minutes by rotating the container. Next, the sample after being barrel-polished was taken out of the container, cleaned, and dried by using a dryer.

Next, the sample was placed again in the sagger made of $ZrO_2$, and the sample was fired in a firing furnace at 1100° C. for one hour. Through the process described above, the ceramic core 20 of each of Examples 1 to 5 was made.

Next, an Ag paste was applied to the end surfaces 46 of the flange portions 40 of the ceramic core 20, baking treatment was performed at 700° C. to form an underlying layer, and the electrodes 50 were formed by alternately forming a Ni plating layer and a Sn plating layer on the underlying layer. Next, the wire 55, having a diameter of 20 μm, was wound around the axial core 30 by using a coil winder; both end portions of the wire 55 were joined to the electrodes 50 by thermocompression bonding; and thereby the coil component 10 of each of Examples 1 to 5 was made.

Comparative Example 1

In the heat treatment step, the heat treatment temperature (highest temperature) was set at 1100° C. (which was the same as the firing temperature). In other respects, the production method and the production conditions were the same as those of Examples 1 to 5.

Comparative Example 2

The heat treatment step was omitted. Instead, a firing step was performed, and then a barrel polishing step was performed. That is, after forming a molded body, the molded body was placed in a sagger made of $ZrO_2$, and the molded body was fired in a firing furnace at 1100° C. for one hour. Next, the sample after being fired (sintered body) was barrel-polished in the same way as Examples 1 to 5, and a ceramic core of Comparative example 2 was made. The sample of Comparative example 2 was not fired after being barrel-polished. In other respects, the production method and the production conditions were the same as those of Examples 1 to 5.

Under the conditions described above, multiple samples of each of Examples 1 to 5 and Comparative examples 1 and 2 were made, and the samples were evaluated as follows.

Average Grain Diameter

Images of surfaces of five portions (each having a size of 30×40 μm) of each of the samples (calcined bodies) of Examples 1 to 5 and Comparative example 1 were captured by using a scanning electron microscope (made by JEOL, JSM-6390A) at a magnification of 3000 times. For each of the crystal grains in the captured images, by using image-analysis grain-diameter-distribution measurement software "Mac-View" (made by Mountech Co., Ltd.), the diameter (Heywood diameter (equivalent circle diameter)) of the crystal grain was obtained (the number of the crystal grains in the five portions was equal to or more than 200). The average grain diameter of the crystal grains in the five portions was calculated, and the calculated average grain diameter was used as the average grain diameter D1 after heat treatment.

Also for the sample of Comparative example 2 after being fired, the average grain diameter of the crystal grains in the five portions was calculated, and the calculated average grain diameter was used as the average grain diameter D2 after firing.

Moreover, the ratios D1/D2 of the average grain diameters D1 of Examples 1 to 5 and Comparative example 1 to the average grain diameter D2 of Comparative example 2 were respectively calculated. Table 1 shows the results.

Percentage of Fault Due to Chipping or Breakage

Fifty samples were drawn from the samples of each of Examples 1 to 5 and Comparative examples after being barrel-polished. The samples were visually observed, the number of samples in which chipping or breakage had occurred was counted, and the percentage of chipped or broken samples was calculated. Table 1 shows the results.

Surface Roughness Rz

For the samples of Examples 1 to 5 and Comparative example 1 after being fired and the sample of Comparative example 2 after being barrel-polished, the surface roughness Rz of each ridge portion 30R of the axial core 30 over a length of 250 μm was measured by using a laser microscope (LEXT OLS4000 made by Olympus Corporation). The surface roughness Rz was measured for ten samples of each of Examples 1 to 5 and Comparative examples 1 and 2. Table 1 shows the largest values of the surface roughness Rz.

Flexural Strength

For each of the samples of Examples 1 to 5 and Comparative example 1 after being fired and the sample of Comparative example 2 after being barrel-polished, a stylus was pressed against the axial core 30 with a gradually increasing load, and the three-point bending strength (flexural strength) of the sample was obtained from a load that was applied when the sample broke. Table 1 shows the results.

Microcrack

For five samples of each of Examples 1 to 5 and Comparative example 1 after being fired and five samples of Comparative example 2 after being barrel-polished, polishing was performed by using an ion milling device IM4000 (made by Hitachi High-Technologies Corporation) to expose a cross-section of the axial core 30 and cross sections of the flange portions 40. Next, by using a scanning electron microscope (made by JEOL, JSM-6390A), the entire areas of the exposed cross sections of the axial core 30 and the flange portions 40 were observed at a magnification of 10000 times, and the presence/absence of a microcrack was checked. If at least one microcrack was found in the observed cross section, the evaluation was "present (microcrack present)". If no microcrack was found in the observed cross section, the evaluation was "absent (microcrack absent)". Table 1 shows the results.

Faulty Winding

From the samples (coil components) of each of Examples 1 to 5 and Comparative examples 1 and 2, in each of which the wire 55 was wound around the axial core 30, thirty samples were drawn. The samples were observed by using an optical microscope to check whether faulty winding of the wire 55 had occurred. If there was at least one sample in which the wire 55 was not wound at regular intervals, the evaluation was "present (faulty winding present)". If the wire 55 was wound at regular intervals in all of the samples, the evaluation was "absent (faulty winding absent)". Table 1 shows the results.

TABLE 1

| | Heat Treatment Temperature (° C.) | After Heat Treatment: Average Grain Diameter D1, D2 (μm) | After Heat Treatment: Ratio D1/D2 | After Barrel-polishing Percentage of Chipping or Breakage (%) | After Firing: Surface Roughness Rz of Ridge Portion (μm) | After Firing: Flexural Strength (Mpa) | After Firing: Presence/Absence of Microcrack | Coil Faulty Winding |
|---|---|---|---|---|---|---|---|---|
| Example 1 | 900 | 0.8 | 0.10 | 16 | 0.9 | 388 | absent | absent |
| Example 2 | 950 | 0.9 | 0.11 | 8 | 1.0 | 393 | absent | absent |
| Example 3 | 1000 | 1.2 | 0.15 | 0 | 1.1 | 396 | absent | absent |
| Example 4 | 1050 | 2.4 | 0.29 | 0 | 2.1 | 397 | absent | absent |
| Example 5 | 1075 | 4.0 | 0.49 | 0 | 2.5 | 389 | absent | absent |
| Comparative example 1 | 1100 | 6.3 | 0.77 | 0 | 4.2 | 331 | present | present |
| Comparative example 2 | not performed | 8.2 | 1.00 | 0 | 5.5 | 268 | present | present |

As shown in Table 1, in Comparative example 1, in which heat treatment was performed at 1100° C., the average grain diameter D1 after heat treatment increased, and the ratio D1/D2 was 0.77, which was greater than 0.5. In Comparative example 1, the surface roughness Rz of each ridge portion 30R was 4.2 μm, which was greater than 2.5 μm after firing. This showed that faulty winding occurred in the coil component. Presumably, the reason for this is as follows: in the samples of Comparative example 1, the surface roughness Rz of each ridge portion 30R after being heat-treated (that is, during barrel polishing) was high, because the average grain diameter D1 was large. Barrel polishing proceeds as crystal grains come off a sample that is being barrel-polished. Therefore, in the samples of Comparative example 1, crystal grains that had grown to have a large grain diameter come off the samples during barrel polishing, so that the surface roughness Rz of each ridge portion 30R was high. This indicates that, if the surface roughness Rz of each ridge portion 30R is large, when the wire 55, which is a very thin wire having a diameter of 20 μm, is wound around the axial core 30, faulty winding, such as irregular winding of the wire 55, breakage of the wire 55, or coating detachment, occurs.

In Comparative example 1, microcracks were found in the samples after being fired. This is presumably because, in Comparative example 1, firing of the molded body 20A had been almost finished during heat treatment and the potential of grain growth during firing was low, so that microcracks that had appeared during barrel polishing were not closed even when firing was performed. The flexural strengths of the samples of Comparative example 1, having the microcracks, were low.

In Comparative example 2, in which heat treatment was not performed and barrel polishing was performed after firing, the surface roughness Rz of each ridge portion 30R was 5.5 μm, which was large; and faulty winding, such as irregular winding, occurred in the coil component. Presumably, in the samples of Comparative example 2, the surface roughness Rz of each ridge portion 30R was large because, as in Comparative example 1, the diameter of crystal grains during barrel polishing (that is, after firing) was large. In Comparative example 2, because barrel polishing was performed after firing, microcracks appeared in the ceramic core during barrel polishing. Therefore, in Comparative example 2, microcracks were found in the ceramic core after being barrel-polished. The flexural strengths of the samples of Comparative example 2, having microcracks, were low.

In contrast, the ratio D1/D2 of Examples 1 to 5, which were heat-treated at 900 to 1075° C., was in the range of 0.1 to 0.5. The average grain diameter D1 of Examples 1 to 5 after heat treatment (that is, during barrel polishing) was in the range of 0.8 to 4 μm, which was small, so that the surface roughness Rz of each ridge portion 30R after being fired was less than or equal to 2.5 μm, which was small. This indicates that, in Examples 1 to 5, in which the surface roughness Rz of each ridge portion 30R was small, even when the wire 55, which is very thin and has a diameter of 20 μm, was wound around the axial core 30, faulty winding of the wire 55, such as irregular winding, did not occur.

In Examples 1 to 5, microcracks were not found in the observed areas of the ceramic core after being fired. This is presumably because, in Examples 1 to 5, because heat treatment was performed so that sintering of the molded body 20A did not considerably proceed in order to provide sufficient potential of grain growth during firing, microcracks, which had appeared during barrel polishing, could be closed by firing. The flexural strengths of Examples 1 to 5, in which microcracks were not found, were higher than those of Comparative examples 1 and 2.

In Examples 3 to 5, in which heat treatment was performed at temperatures in the range of 1000 to 1075° C., the ratio D1/D2 was in the range of 0.15 to 0.5. In Examples 3 to 5, occurrence of chipping or breakage during barrel polishing was reduced compared with Examples 1 and 2. This is presumably because the strength of the calcined bodies of Examples 3 to 5, which were heat-treated at higher temperatures than Examples 1 and 2, was higher than that of Examples 1 and 2. In Examples 3 to 5, the surface roughness Rz of each ridge portion 30R after being fired was in the range of 1.1 to 2.5 μm.

The above results show that, by performing heat treatment so that the ratio D1/D2 is in the range of 0.1 to 0.5, occurrence of faulty winding of the wire 55 can be effectively suppressed. Thus, decrease in the production yield can be suppressed. Moreover, by performing heat treatment so that the ratio D1/D2 is in the range of 0.15 to 0.5, occurrence of chipping or breakage during barrel polishing can be reduced. Thus, decrease in the production yield can be further suppressed.

The present disclosure is not limited to Examples described above. The type of material powder used for producing the ceramic core; specific conditions for the molding step, the heat treatment step, the barrel polishing step, the firing step and the like; the structure of the wire; and the like may be modified in various ways.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A ceramic core comprising:

an axial core extending in a length direction; and a pair of flange portions disposed at both ends of the axial core in the length direction, wherein the ceramic core is composed of a ferrite material including Ni and Zn, wherein a dimension L of the ceramic core in the length direction satisfies 0 mm<L≤1.1 mm, and wherein a surface roughness Rz of a ridge portion of the axial core is less than or equal to 2.5 μm, the surface roughness Rz being a ten-point-mean roughness.

2. The ceramic core according to claim 1, wherein each of the flange portions projects from the axial core in a height direction and a width direction that are perpendicular to the length direction, wherein a ratio t/T of a dimension t of the axial core in the height direction to a dimension T of each of the flange portions in the height direction satisfies 0<t/T≤0.6, and wherein a ratio w/W of a dimension w of the axial core in the width direction to a dimension W of each of the flange portions in the width direction satisfies 0<w/W≤0.6.

3. The ceramic core according to claim 1, wherein a dimension of each of the flange portions in the length direction is in a range of 0.08 to 0.15 mm.

4. The ceramic core according to claim 1, wherein a center of the axial core in a height direction that is perpendicular to the length direction is offset from a center of each of the flange portions in the height direction.

5. A wire-wound electronic component comprising:

the ceramic core according to claim 1;

an electrode formed on one of end surfaces of each of the flange portions in a height direction that is perpendicular to the length direction; and a wire that is wound around the axial core and that includes end portions that are electrically connected to the electrodes.

* * * * *